US005464552A

United States Patent [19]

Peterson et al.

[11] Patent Number: 5,464,552

[45] Date of Patent: Nov. 7, 1995

[54] STABLE LIQUID AQUEOUS OXIDANT DETERGENT

[75] Inventors: David Peterson, Pleasanton; Gregory V. Buskirk, Danville, both of Calif.

[73] Assignee: The Clorox Company, Oakland, Calif.

[21] Appl. No.: 330,236

[22] Filed: Oct. 27, 1994

Related U.S. Application Data

[63] Continuation of Ser. No. 147,414, Nov. 5, 1993, abandoned, which is a continuation of Ser. No. 864,374, Apr. 6, 1992, abandoned, which is a continuation of Ser. No. 444,175, Nov. 30, 1989, abandoned.

[51] Int. Cl.[6] ..... C11D 3/04; C11D 3/39; C11D 3/395

[52] U.S. Cl. ..... 252/95; 252/99; 252/104; 252/135; 252/139; 252/173; 252/DIG. 14; 252/186.26; 252/186.27; 252/186.3; 252/186.31; 252/186.42; 252/186.43

[58] Field of Search ..... 252/95, 99, 104, 252/135, 186.27, 186.3, 186.43, DIG. 14, 173, 139, 186.31, 186.26, 186.42

[56] References Cited

U.S. PATENT DOCUMENTS

| | | | |
|---|---|---|---|
| 3,600,318 | 8/1971 | Mast | 252/99 |
| 3,751,222 | 8/1973 | Gobert | 252/99 |
| 3,852,210 | 12/1974 | Krezanoski | 252/95 |
| 3,970,575 | 7/1976 | Barrett, Jr. | 252/95 |
| 3,974,082 | 8/1976 | Weyn | 252/99 |
| 3,996,151 | 12/1976 | Kirner | 252/186 |
| 4,130,501 | 12/1978 | Lutz | 252/186 |
| 4,166,794 | 9/1979 | Grey | 252/8.8 |
| 4,238,192 | 12/1980 | Kandathil | 8/111 |
| 4,298,492 | 11/1981 | Van de Brom | 252/97 |
| 4,347,149 | 8/1982 | Smith | 252/102 |
| 4,404,116 | 9/1983 | Tai | 252/135 |
| 4,430,236 | 2/1984 | Franks | 252/95 |
| 4,462,922 | 7/1984 | Boskamp | 252/174.12 |
| 4,465,619 | 8/1984 | Boskamp | 252/540 |
| 4,470,919 | 9/1984 | Goffinet et al. | 252/102 |
| 4,515,704 | 5/1985 | Akred et al. | 252/135 |
| 4,525,291 | 6/1985 | Smith et al. | 252/92 |
| 4,526,702 | 7/1985 | Parr | 252/135 |
| 4,532,064 | 7/1985 | Boskamp | 252/135 |
| 4,539,133 | 9/1985 | Boskamp | 252/135 |
| 4,618,446 | 10/1986 | Haslop et al. | 252/135 |
| 4,652,394 | 3/1987 | Inamorato et al. | 252/174.12 |
| 4,659,497 | 4/1987 | Akred et al. | 252/135 |
| 4,670,179 | 6/1987 | Inamorato et al. | 252/174 |
| 4,764,302 | 8/1988 | Baker et al. | 252/301.23 |
| 4,820,436 | 4/1989 | Andree | 252/90 |
| 4,874,537 | 10/1989 | Peterson et al. | 252/DIG. 14 |
| 4,891,147 | 1/1990 | Gray et al. | 252/95 |
| 4,900,475 | 2/1990 | Ramachandran | 252/532 |
| 4,929,377 | 5/1990 | Emmons et al. | 252/95 |

FOREIGN PATENT DOCUMENTS

| | | | |
|---|---|---|---|
| 209228 | 1/1987 | European Pat. Off. | C11D 3/39 |
| 293040 | 11/1988 | European Pat. Off. | C11D 3/39 |
| 294904 | 12/1988 | European Pat. Off. | C11D 3/39 |
| 301884 | 2/1989 | European Pat. Off. | C11D 17/00 |
| 333014 | 9/1989 | European Pat. Off. | C11D 1/83 |
| 338921 | 11/1989 | European Pat. Off. | C11D 3/39 |
| 349153 | 1/1990 | European Pat. Off. | C11D 3/39 |
| 378262 | 7/1990 | European Pat. Off. | C11D 3/386 |
| 378261 | 7/1990 | European Pat. Off. | C11D 3/386 |
| 90/15857 | 12/1990 | WIPO | C11D 3/39 |
| 91/09103 | 6/1991 | WIPO | C11D 3/395 |

OTHER PUBLICATIONS

C. Miller et al., "Behavior of Dilute Lamellar Liquid—Crystal and Phases," *Colloids and Surfaces*, vol. 19, pp. 198–223 (Jan. 1986).

W. J. Benton et al., "Lyotropic Liquid Crystalline Phases . . . ," *J. Physical Chemistry*, vol. 87, pp. 4981–4991 (Mar. 1983).

*Primary Examiner*—Paul Lieberman
*Assistant Examiner*—E. Harriman
*Attorney, Agent, or Firm*—Joel J. Hayashida; Sharon R. Kantor

[57] ABSTRACT

The invention provides a phase stable liquid detergent containing at least one particulate oxidant, comprising:

a) a liquid phase which comprises: i) an effective amount of at least one surfactant selected from the group consisting of anionic, nonionic, cationic, amphoteric, zwitterionic surfactants, and mixtures thereof; ii) a liquid carrier therefore, comprising organic Solvents, water, or a mixture thereof;

b) an effective amount of a particulate oxidant stably suspended in said liquid phase, which maintains oxidative stability, said oxidant being selected from the group consisting of alkali metal perborate and percarbonates; and c) an oxidant stabilizer selected from the group consisting of alkali metal chloride, alkali metal borate, boric acid and mixtures thereof.

24 Claims, No Drawings

STABLE LIQUID AQUEOUS OXIDANT DETERGENT

This is a continuation of application Ser. No. 08/147,414 filed 5 Nov. 1993, now abandoned, which is in turn a continuation of application Ser. No. 07/864,374 filed Apr. 6, 1992, now abandoned which is in turn a continuation of application Ser. No. 07/444,175 filed Nov. 30, 1989 now abandoned.

BACKGROUND OF THE INVENTION

1. Field of the Invention

This invention relates to phase stable, liquid detergents, which contain solid oxidants, preferably sodium perborate, which maintains surprisingly good oxidative stability by the use of an alkali metal borate, boric acid, an alkali metal chloride, or a mixture thereof.

2. Brief Description of Related Art

Liquid detergents are desirable alternatives to dry, granular detergent products. While dry, granular detergents have found wide consumer acceptance, liquid products can be adapted to a wide variety of uses. For example, liquid products can be directly applied to stains and dirty spots on fabrics, without being predissolved in water or other fluid media. Further, a "stream" of liquid detergent can be more easily directed to a targeted location in the wash water or clothing than a dry, granular product.

There have been many attempts to formulate liquid detergents which contain oxidants.

For example, Krezanoski, U.S. Pat. No. 3,852,210, Lutz et al., U.S. Pat. No. 4,130,501, and Smith et al., U.S. Pat. No. 4,347,149, disclose liquid hydrogen peroxide-based bleach compositions at relatively low pH's containing relatively minor amounts of surfactants. The disadvantage with these compositions would be rather low detergency, owing to the low amount of surfactants.

Franks, U.S. Pat. No. 4,430,236, Goffinet et al., U.S. Pat. No. 4,470,919, and Smith et al., U.S. Pat. No. 4,525,291, disclose higher amounts of hydrogen peroxide and surfactant. However, in order to preserve the oxidant, the compositions generally require the addition of various stabilizing agents, such as a lower alcohol and an amino polyphosphonate (Smith et al.) or fatty acids and soluble calcium salts (Goffinet et al.).

However, none of the foregoing references, or any combination thereof, teaches, discloses or suggests that solid oxidants may be stably incorporated in a liquid detergent medium. None of the foregoing art further teaches that oxidant stability of such solid oxidants can be surprisingly well maintained by use of an alkali metal borate, an alkali metal chloride, or a mixture thereof.

Haslop et al., U.S. Pat. No. 4,618,446, disclose liquid compositions containing spherulitic formations by combining anionic and nonionic surfactants with relatively high amounts of electrolytes, e.g., sodium chloride. Although Haslop states that "Bleaches may optionally be incorporated in compositions of [its] invention . . . ," it recognizes that this is ". . . subject to chemical stability and compatibility" (Column 26, lines 11–13). Haslop even teaches away from the concept that excellent oxidant stability could result in a liquid formulation containing particulate oxidants, since Haslop suggests using "encapsulated bleaches." (Id.)

SUMMARY OF THE INVENTION AND OBJECTS

The invention provides a phase stable liquid detergent containing at least one oxidant, comprising:

a) a liquid phase which comprises: i) an effective amount of at least one surfactant selected from the group consisting of anionic, nonionic, cationic, amphoteric, zwitterionic surfactants, and mixtures thereof; ii) a liquid carrier therefore, comprising organic solvents, water, or a mixture thereof;

b) an effective amount of a solid, particulate oxidant stably suspended in said liquid phase, which maintains oxidative stability, said oxidant being selected from the group consisting of an alkali metal perborate monohydrate, alkali metal perborate tetrahydrate, and alkali metal percarbonate; and c) an oxidant stabilizing amount of a stabilizer which is an alkali metal borate, boric acid, an alkali metal chloride, or a mixture thereof.

In a further embodiment of the invention, is provided a phase stable liquid detergent containing an oxidant, said detergent comprising:

a) a structured liquid phase which comprises: i) a mixture of anionic surfactants; a mixture of nonionic surfactants; or a mixture of anionic and nonionic surfactants, in a proportion sufficient to result in a liquid structure capable of dispersing solids insoluble in said liquid phase; and ii) a fluid carrier therefor which comprises water, a water soluble or dispersible organic solvent, or a mixture thereof; and b) an effective amount of an oxidant stably suspended in said liquid phase, which oxidant maintains oxidative stability, said oxidant being an alkali metal perborate monohydrate, alkali metal perborate tetrahydrate, or alkali metal percarbonate; and c) an oxidant stabilizing amount of a stabilizer which is an alkali metal borate, boric acid, an alkali metal chloride, or a mixture thereof.

Various adjuncts known to those skilled in the art can be included in these liquid detergent compositions.

It is therefore an object of this invention to provide a liquid detergent containing an oxidant which has good oxidative stability.

It is a further object of this invention to provide a phase stable liquid detergent in which a particulate oxidant is stably suspended or dispersed in the continuous liquid phase comprising surfactants and a liquid carrier therefor.

It is yet another object Of this invention to provide a liquid detergent containing an oxidant suspended therein which has improved stability over like detergents containing hydrogen peroxide.

It is moreover an object of this invention to provide a liquid detergent containing an oxidant suspended therein which is relatively benign to enzymes, fluorescent whitening agents, and other oxidation sensitive materials.

DETAILED DESCRIPTION OF THE PREFERRED EMBODIMENT

The invention provides a phase stable liquid detergent containing at least one oxidant stably suspended therein. The advantage of the detergent over existing liquid hydrogen peroxide based detergents is multifold. First, many off those liquid oxidant detergents described in the literature contain relatively small amounts of actives, such as surfactants, fluorescent whitening agents, enzymes, and the like. The reason for this is that such detergent actives are relatively unstable in aqueous liquid oxidant media, such as liquid hydrogen peroxide. In order to circumvent this problem, many references have taught the use of various stabilizers (e.g., Smith et al., U.S. Pat. Nos. 4,347,149 and 4,525,291, and Goffinet et al., U.S. Pat. No. 4,470,919). However, the problem of relatively small amounts of effective detergent actives remains. Next, when liquid oxidant detergents are formulated, it is always problematic to incorporate enzymes, fluorescent whitening agents, or the like in such compositions since they have a tendency to become deactivated in such formulations. In the present invention, by contrast, the particulate oxidant, which is selected from sodium perborate monohydrate, sodium perborate tetrahydrate, or sodium percarbonate, is suspended in the aqueous medium but kept relatively insoluble therein, by the use of the inventive stabilizing system.

The ingredients of the present liquid detergents are described herein:

1. The Liquid Phase

The liquid phase is a mixture of an effective amount of at least one surfactant combined with a liquid or fluid carrier therefor. The carrier comprises water, organic solvents, or a mixture thereof.

a. Surfactants

The surfactant can be selected from anionic, nonionic, cationic, zwitterionic, amphoteric surfactants, and mixtures thereof. The types and combination of surfactants used depends on the intended end use, i.e., whether greasy soils or particulate soils are targeted for removal, or cost, or clarity, or other attributes.

Particularly effective surfactants appear to be anionic surfactants. Examples of such anionic surfactants may include the ammonium, substituted ammonium (e.g., mono-, di-, and tri-ethanolammonium), alkali metal and alkaline earth metal salts of $C_6$–$C_{20}$ fatty acids and rosin acids, linear and branched alkyl benzene sulfonates, alkyl sulfates, alkyl ether sulfates, alkane sulfonates, olefin sulfonates, hydroxyalkane sulfonates, fatty acid monoglyceride sulfates, alkyl glyceryl ether sulfates, acyl sarcosinates and acyl N-methyltaurides. Preferred are aromatic sulfonated surfactants. Of particular preference are alkyl ether sulfates and linear and branched $C_{6-18}$ alkyl benzene sulfonates, both the salts thereof as well as the acidic form. The anionic surfactant should be present in the liquid detergent at about 0–504%, more preferably 1–40%, and most preferably, 5–35%, by weight of the composition.

The nonionic surfactants presenting the invention will preferably have a pour point of less than 40° C., more preferably less than 35° C., and most preferably below about 30° C. They will have an HLB (hydrophile-lipophile balance) of between 2 and 16, more preferably between 4 and 15, and most preferably between 10 and 14. However, mixtures of lower HLB surfactants with higher HLB surfactants can be present, the resulting HLB usually being a weighted average of the two or more surfactants. Additionally, the pour points of the mixtures can be, but are not necessarily, weighted averages of the surfactants used.

The nonionic surfactants are preferably selected from the group consisting of $C_{6-18}$ alcohols with 1–15 moles of ethylene oxide per mole of alcohol, $C_{6-18}$ alcohols with 1–10 moles of propylene oxide per mole of alcohol, $C_{6-18}$ alcohols with 1–15 moles of ethylene oxide and 1–10 moles of propylene oxide per mole of alcohol, $C_{6-18}$ alkylphenols with 1–15 moles of ethylene oxide or propylene oxide or both, and mixtures of any of the foregoing. Certain suitable surfactants are available from Shell Chemical Company under the trademark Neodol. Suitable surfactants include Neodol 25-9 ($C_{12-15}$ alcohol with an average 9 moles of ethylene oxide per mole of alcohol). Another suitable surfactant may be Alfonic 1218–70, which is based on a $C_{12-18}$ alcohol and which is ethoxylated with about 10.7 moles of ethylene oxide per mole of alcohol, from Vista Chemical, Inc. These and other nonionic surfactants used in the invention can be either linear or branched, or primary or secondary alcohols. If surfactants used are partially unsaturated, they can vary from $C_{10-22}$ alkyoxylated alcohols, with a minimum iodine value of at least 40, such as exemplified by Drozd et al., U.S. Pat. No. 4,668,423, incorporated herein by reference. An example of an ethoxylated, propoxylated alcohol is Surfonic JL-80X ($C_{9-11}$ alcohol with about 9 moles of ethylene oxide and 1.5 moles of propylene oxide per mole of alcohol), available from Texaco Chemical Company.

Other suitable nonionic surfactants may include polyoxyethylene carboxylic acid esters, fatty acid glycerol esters, fatty acid and ethoxylated fatty acid alkanolamides, certain block copolymers of propylene oxide and ethylene oxide and block polymers of propylene oxide and ethylene oxide with a propoxylated ethylene diamine (or some other suitable initiator). Still further, such semi-polar nonionic surfactants as amine oxides, phosphine oxides, sulfoxides and their ethoxylated derivatives, may be suitable for use herein.

Nonionic surfactants are useful in this invention since they are generally found in liquid form, usually contain 100% active content, and are particularly effective at removing oily soils, such as sebum and glycerides.

Suitable cationic surfactants may include the quaternary ammonium compounds in which typically one of the groups linked to the nitrogen atom is a $C_{12}$–$C_{18}$ alkyl group and the other three groups are short chained alkyl groups which may bear substituents such as phenyl groups.

Further, suitable amphoteric and zwitterionic surfactants which contain an anionic water-solubilizing group, a cationic group and a hydrophobic organic group may include amino carboxylic acids and their salts, amino dicarboxylic acids and their salts, alkylbetaines, alkyl aminopropylbetaines, sulfobetaines, alkyl imidazolinium derivatives, certain quaternary ammonium compounds, certain quaternary phosphonium compounds and certain tertiary sulfonium compounds. Other examples of potentially suitable zwitterionic surfactants can be found described in Jones, U.S. Pat. No. 4,005,029, at columns 11–15, which are incorporated herein by reference.

Further examples of anionic, nonionic, cationic and amphoteric surfactants which may be suitable for use in this invention are depicted in Kirk-Othmer, *Encyclopedia of Chemical Technology*, Third Edition, Volume 22, pages 347–387, and *McCutcheon's Detergents and Emulsifiers*, North American Edition, 1983, which are incorporated herein by reference.

It has been, however, found that the most effective liquid phase comprises a mixture of anionic surfactants; or a mixture of anionic and nonionic surfactants, along with the liquid or fluid carrier therefor. The mixture of surfactants is such as to form a structured liquid. It forms a three-dimensional structure which is capable of stably suspending particulate matter. This structured liquid is not entirely understood, but apparently occurs because of interaction between the surfactants and the electrolytes in the liquid phase. Such interaction is not believed to be a charged-based interaction, but maybe due to unique microcrystalline structures occurring in the liquid phase. See, e.gs., P. Ekwall, "Composition, Properties and Structures of Liquid Crystal and Phases in Systems of Amphiphilic Compounds"; and C. Miller et al., "Behavior of Dilute Lamellar Liquid-Crystal and Phases." *Colloids and Surfaces*, Vol. 19, pp. 197–223 (1986); and W. J. Benton et al., "Lyotropic Liquid Crystalline Phases and Dispersions in Dilute Anionic Surfactant-Alcohol-Brine Systems," *J. Physical Chemistry*, Vol. 87, pp. 4981–4991 (1983), which are incorporated herein by reference. The yield values for these structured liquids should be preferably between about 1–15 Pascals (dyne/cm$^2$), more preferably 2–10 Pascals, as measured on a Bohlin Constant Stress Rheometer.

In the present invention, it is most preferred that the mixture of surfactants comprise either a mixture of anionic surfactants; a mixture of nonionic surfactants; or a mixture of anionic and nonionic surfactants. Where mixtures of anionics are used, they preferably comprise those selected from alkyl ether sulfate, alkyl benzene sulfonate, alkyl sulfates and mixtures thereof. Regarding the latter surfactants, it appears that sulfonated or sulfated anionic surfactants are necessary in order to form the liquid structure to stably suspend the insoluble oxidants. It is especially preferred that the alkyl ether sulfates (also known as alcohol alkoxysulfate anionic surfactants) have the following structure:

$$R—(—OCH_2CH_2—)_nSO_4M$$

Wherein R is a $C_{10-16}$ alkyl, and n is an integer from about 1–10, and M is H or an alkali metal cation (sodium, potassium or lithium. The alkyl benzene sulfonate, on the other hand, is preferably a $C_{6-18}$ alkyl benzene sulfonate. Especially preferred are $C_{9-18}$ alkyl benzene sulfonates, and most especially preferred are $C_{10-14}$ alkyl benzene sulfonates. Exemplary of the alkyl ether sulfates is Neodol 25-3S, from Shell Chemical Company, while an appropriate alkyl benzene sulfonate is Calsoft F-90 (90% active, solid) sodium $C_{11.5}$ alkyl benzene sulfonate, from Pilot Chemical Company. The acidic form of these surfactants, HLAS, may also be appropriate. For example, Bio-Soft S-130 available from Stepan Chemical Company, may also be suitable for use herein. See also the description of acidic surfactants in Choy et al., U.S. Pat. No. 4,759,867 incorporated herein by reference. The alkyl sulfates should be $C_{10-18}$ surfactants, representative of which is sodium lauryl sulfate.

When the combination of surfactants is used, it is preferred that the two major surfactants be in a ratio of about 20:1 to about 1:20, more preferably 10:1 to 1:10, and most preferably 4:1 to 1:4. The resulting liquid composition should preferably have a viscosity of about 1–5,000 milli-Pascal · seconds (mPaS), more preferably 5–3,000 mPaS, and most preferably about 10–1,500 mPaS. Effective amounts of surfactants are amounts which will result in at least threshold cleaning, and can range from about 0.1–90%.

b. Liquid Carrier.

The liquid carrier for the surfactants is water, organic solvents, or a mixture thereof.

Water is the principal fluid medium for carrying the surfactants. Typically, deionized or softened water is used, since it is desirable to avoid large amounts of heavy metals and impurities, such as found in ordinary, hard water.

The organic solvents include lower alkanols, e.g., ethanol, propanol, and possible butanol; glycols (or diols) such as ethylene glycol, and propylene glycol; glycol ethers, such as butyl, ethyl and methyl Cellosolve (Union Carbide) and propylene glycol t-butyl ether (Arcosolve PTB, Arco Chemical Co.); and mixtures thereof. Glycerol may also be an acceptable solvent.

It is preferable that water comprise a major portion of the liquid carrier, and should, be present in an amount from 5 to 95% by weight of the composition, more preferably 25 to about 90%, and most preferably about 50 to about 85%. The organic solvent may be present in the same amounts, but preferably, comprises only about 0 to about 10%, more preferably 0 to about 5%, and most preferably about 0 to about 3% of the liquid carrier. In the invention, the presence of any solvent is principally attributable to the use of anionic surfactants, enzyme solutions, etc., some of which may contain residual amounts of solvents, e.g., ethanol or propylene glycol. High levels of the solvents are considered unnecessary since they could drive up materials costs and could affect physical stability of the compositions. In certain instances, high levels of solvents, e.g., lower alcohols, can pose flammability concerns.

2. The Oxidant

The oxidant comprises a significant portion of the solid phase suspended in the liquid phase. The oxidant is preferably selected from alkali metal perborate monohydrate, alkali metal perborate tetrahydrate or alkali metal percarbonate. Preferably, any of sodium perborate mono- and tetrahydrate-, and sodium percarbonate, could be used.

The above oxidants are considered fairly water soluble and it is surprising that, using the stabilizers described below, they maintain good oxidant stability.

However, it is preferable that the oxidant, and other materials comprising the solids portion, have a particle size between 1–1,000 microns, or preferably between 1–500 microns, and most preferably between 100–250 microns, average particle size. As discussed the materials are usually used "as is," from the supplier, but the desired particle size can also be obtained by using ball mills or grinders.

The amount of oxidant to be delivered per use in the wash water is a level of preferably about 0.5 to 100 ppm A.O. per use, and most preferably 1–50 ppm A.O. The effective amount of oxidant in the composition to provide these use levels varies, but can range from 0.1–50% by weight of the composition.

3. The Stabilizer

The oxidant stabilizer used in the invention is an alkali metal borate, an alkali metal chloride, or a mixture thereof. Good examples of such alkali metal borates are borax, which is sodium tetraborate pentahydrate or decahydrate, and sodium metaborate (octahydrate or tetrahydrate). Another proficient stabilizer is boric acid. Mixtures of these boron compounds are suitable, as well. For example, a mixture of boric acid and borax has been used to modify the pH favorably of the inventive compositions. The alkali metal chloride is preferably sodium chloride. It is believed that the stabilizers act to desolubilize the particulate oxidants by maintaining a high ionic strength in the aqueous liquid, thereby maintaining oxidant potency. If boric acid/borax mixture is used, a ratio of about 1 to 25, boric acid: borax is preferred, more preferably about 1 to 10 and most preferably, about 1 to 5. When a mixture of boric acid/borax: chloride is used, the ratio of the boron-containing compound versus chloride is about 1:10 to 10:1, more preferably about 1:5 to 5:1, and most preferably about 1:2 to 2:1. The stabilizer is used at a use level of 1–50%, more preferably 5–30% and most preferably 5–20%.

4. Hydrolase

Enzymes are especially desirable adjunct materials in these liquid detergents. Desirably, in order to maintain optimal activity of these enzymes in these aqueous detergents, it is preferred that an enzyme stabilizer be present. The enzymes used herein are hydrolytic enzymes, or hydrolases, which act by hydrolyzing a given substrate (stain or soil), converting the substrate to a more soluble or easily removed form.

Proteases are one especially preferred class of enzymes. They are selected from acidic, neutral and alkaline proteases. The terms "acidic," "neutral," and "alkaline, " refer to the pH , at which the enzymes' activity are optimal. Examples of neutral proteases include Milezyme (available from Miles Laboratory) and trypsin, a naturally occurring protease. Alkaline proteases are available from a wide variety of sources, and are typically produced from various microorganisms (e.g., *Bacillis subtilisin*). Typical examples of alkaline proteases include Maxatase and Maxacal from International BioSynthetics, Alcalase, Savinase and Esperase, all available from Novo Industri A/S. See also Stanislowski et al., U.S. Pat. No. 4,511,490, incorporated herein by reference.

Further suitable enzymes are amylases, which are carbohydrate-hydrolyzing enzymes. It is also preferred to include mixtures of amylases and proteases. Suitable amylases include Rapidase, from Société Rapidase, Termamyl from Novo Industri A/S, Milezyme from Miles Laboratory, and Maxamyl from International BioSynthetics.

Still other suitable enzymes are cellulases, such as those described in Tai, U.S. Pat. No. 4,479,881, Murata et al., U.S. Pat. No. 4,443,355, Barbesgaard et al., U.S. Pat. No. 4,435,307, and Ohya et al., U.S. Pat. No. 3,983,082, incorporated herein by reference.

Yet other suitable enzymes are lipases, such as those described in Silver, U.S. Pat. No. 3,950,277, and Thom et al., U.S. Pat. No. 4,707,291, incorporated herein by reference.

The hydrolytic enzyme should be present in an amount of about 0.01–5%, more preferably about 0.01–3%, and most preferably about 0.1–2% by weight of the detergent. Mixtures of any of the foregoing hydrolases are desirable, especially protease/amylase blends.

5. Chelating Agent

Chelating agents, such as citric acid, ethylenediaminetetraacetic acid, nitrilotriacetic acid, aminopolyphosphonic acid (e.g, Dequest 2060, from Monsanto), polyphosphonic acid, or their salts, are useful adjuncts. The chelating agents chelate heavy metal ions, and should be resistant to hydrolysis and rapid oxidation by oxidants. Preferably, it should have an acid dissociation constant ($pK_a$) of about 1–9, indicating that it dissociates at low pH's to enhance binding to metal cations. Effective amounts of the chelating agent may be from 1–1,000 ppm, more preferably 5–500, most preferably 10–100 ppm in the wash liquor into which the liquid detergent is introduced.

6. Adjuncts

The standard detergent adjuncts can be included in the present invention. These include dyes, such as Monastral blue and anthraquinone dyes (such as those described in Zielske, U.S. Pat. Nos. 4,661,293, and 4,746,461). Pigments, which are also suitable colorants, can be selected, without limitation, from titanium dioxide, ultramarine blue (see also, Chang et al., U.S. Pat. No. 4,708,816), and colored aluminosilicates. Fluorescent whitening agents are still other desirable adjuncts. These include the stilbene, styrene, and naphthalene derivatives, which upon being impinged by ultraviolet light, emit or fluoresce light in the visible wavelength. These FWA's or brighteners are useful for improving the appearance of fabrics which have become dingy through repeated soilings and washings. Preferred FWA's are Blankophor BBH, RKH and BHC, from Mobay Chemicals, and Tinopal 5BMX-C, CBS-X and RBS, from Ciba-Geigy A.G. Examples of suitable FWA's can be found in U.K. Patents 1,298,577, 2,076,011, 2,026,054, 2,026,566, 1,393,042; and U.S. Pat. Nos. 3,951,960, 4,298,290, 3,993,659, 3,980,713 and 3,627,758, incorporated herein by reference. Enzyme stabilizers such as soluble alkaline earth salts of chlorides, hydroxides; and the soluble alkali metal and alkaline earth salts of acetates, formates, or propionates; potentially discrete amounts of ethylene or propylene glycol; an alkanolamine (for example, triethanolamine); or glycerol, are suitable adjuncts. If the glycol ether is the stabilizer, it is separate from any glycol ether used as the liquid carrier. Anti-redeposition agents, such as carboxymethycellulose, are potentially desirable.

Discrete amounts of an anti-oxidant can be included in these liquid compositions. Although not entirely understood, Applicants believe, without being bound by theory, that the anti-oxidants aid in the chemical stability by "scavenging" minor amounts of peroxide decomposition products present in the liquid phase. By reacting with peroxide decomposition products, the anti-oxidant prevents such products from destabilizing the enzymes and other sensitive adjuncts present in the liquid detergent. Suitable anti-oxidants are, without limitation, substituted phenols and dihydroxybenzenes (e.g., butylated hydroxytoluene ("BHT")), as exemplified in Baker et al., U.S. Pat. No. 4,764,302, and aromatic amines, as exemplified in Fart et al., U.S. application Ser. No. 07/212,447, filed Jun. 28, 1988, now U.S. Pat. No. 5,180,514 entitled "Stabilizing System for Liquid Hydrogen Peroxide Compositions," both references being of common assignment herewith and incorporated herein by reference. Ascorbic acid is another potentially suitable candidate. It is preferred that 0.1–5% by weight of the detergent comprise this anti-oxidant, more preferably, 0.2–5% and most preferably 0.3–3% Next, foam boosters, such as appropriate anionic surfactants, may be appropriate for inclusion herein. Also, in the case of excess foaming resulting from the use of certain nonionic surfactants, further anti-foaming agents, such as alkylated polysiloxanes, e.g., dimethylpolysiloxane, would be desirable. Next, compatible bleach activators could well be very desirable for inclusion herein. Suitable examples of appropriate bleach activators may be found in Mitchell et al., U.S. Pat. No. 4,772,290. Mitchell may be especially appropriate since it describes stable activators in an aqueous liquid hydrogen peroxide composition and it is incorporated herein by reference. However, since the oxidants will not apparently provide large amounts of free hydroperoxide in solution, it may be acceptable to add other activators such as those enumerated in Zielske, EP 267,047 (incorporated herein by reference), which are alkanoyloxynitrogen or alkyloxyacetyl, oxynitrogen compounds. Lastly, in case the composition is too thin, some thickeners such as gums (xanthan gum and guar gum) and various resins (e.gs., polyvinyl alcohol and polyvinyl pyrrolidone) may be suitable for use. Fragrances are also desirable adjuncts in these compositions.

The additives may be present in amounts ranging from 0–30%, more preferably 0–20%, and most preferably 0–10%. In certain cases, some of the individual adjuncts may overlap in other categories. For example, some surface active esters may actually function to a limited extent as surfactants. However, the present invention contemplates each of the adjuncts as providing discrete performance benefits in their various categories.

The Experimental section below further describes and embodies the advantages of these novel liquid detergent compositions.

EXPERIMENTAL

In the following set of experiments, the oxidative stability of suspended oxidants was compared against that of hydrogen peroxide, and against a non-stabilized system. It was demonstrated that dramatically improved stability of such suspended oxidants was achieved versus hydrogen peroxide to which had been added the same stabilizing system and versus a non-stabilized system.

The following four base compositions were used in oxidant stability testing by Applicants. Unless indicated otherwise, all %'s are by weight %.

| Ingredient | Wt. % |
|---|---|
| FORMULA I (Chloride/Borax Stabilizer) | |
| Sodium Chloride[1] | 15.00% |
| Calcium Chloride[2] | 0.10 |
| Blankophor BBH[3] | 0.26 |
| NaLAS, as 100% active[4] | 3.00 |
| AEOS, as 100% active[5,10] | 12.00 |
| Dequest 2066[6] | 0.50 |
| Fragrance | 0.26 |
| Borax[7] | 10.00 |
| Oxidant as will be indicated[8] | |
| Water | to balance |
| FORMULA II (Chloride/Borax/Boric Acid Stabilizer) | |
| Sodium Chloride[1] | 15.00% |
| Calcium Chloride[2] | 0.10 |
| Blankophor BBH[3] | 0.26 |
| NaLAS, as 100% active[4] | 3.00 |
| AEOS, as 100% active[5,10] | 12.00 |
| Dequest 2066[6] | 0.50 |
| Fragrance | 0.26 |
| Borax[7] | 10.00 |
| Boric Acid[9] | 1.00 |
| Oxidant as will be indicated[8] | |
| Water | to balance |
| FORMULA III (Chloride Stabilizer) | |
| Sodium Chloride[1] | 20.00% |
| Calcium Chloride[2] | 0.10 |
| Blankophor BBH[3] | 0.26 |
| NaLAS, as 100% active[4] | 3.00 |
| AEOS, as 100% active[5,10] | 12.00 |
| Dequest 2066[6] | 0.50 |
| Fragrance | 0.26 |
| Oxidant as will be indicated[8] | |
| Water | to balance |
| COMPARATIVE FORMULA IV (Unstabilized) | |
| Calcium Chloride[2] | 0.10% |
| Blankophor BBH[3] | 0.27 |
| NaLAS, as 100% active[4] | 3.00 |
| AEOS, as 100% active[5,10] | 12.00 |
| Dequest 2066[6] | 0.50 |
| Fragrance | 0.26 |
| Oxidant as will be indicated[8] | |
| Water | to balance |

[1]Oxidant Stabilizer
[2]Enzyme Stabilizer
[3]Fluorescent whitening agent, Mobay Chemicals.
[4]$C_{11.5}$ linear alkylbenzene sulfonate, sodium salt, Pilot Chemicals.
[5]Sodium alkyl ether sulfate, $C_{12}$ alcohol, about 3 moles of ethylene oxide, Shell Chemical Co.
[6]Chelating Agent, Monsanto Company.
[7]Oxidant Stabilizer, borax pentahydrate.
[8]pH adjusted when $H_2O_2$ added to match formulations where perborate is the oxidant.
[9]Oxidant Stabilizer
[10]2.0% total ethanol (solvent) in the AEOS.

TABLE I

OXIDANT STORAGE STABILITY AT COMPARABLE OXIDANT STRENGTH IN DETERGENT FORMULATIONS

| EXAMPLE | ADJUSTED pH | OXIDANT REMAINING AFTER 100 F. STORAGE 1 WEEK | 4 WEEKS |
|---|---|---|---|
| FORMULA I | | | |
| 1. 1% Hydrogen Peroxide | 8.3 | 81 | 45 |
| 2. 3% Na Perborate Monohydrate | 8.3 | 89 | 69 |
| 3. 4.5% Na Perborate Tetrahydrate | 8.1 | 74 | 84 |
| FORMULA II | | | |
| 4. 1% Hydrogen Peroxide | 7.1 | 48 | 4 |
| 5. 3% Na Perborate Monohydrate | 7.4 | 75 | 35 |
| 6. 4.5% Na Perborate Tetrahydrate | 7.2 | 75 | 37 |
| FORMULA III | | | |
| 7. 1% Hydrogen Peroxide | 8.5 | 87 | 76 |
| 8. 3% Na Perborate Monohydrate | 8.7 | 95 | 81 |
| 9. 4.5% Na Perborate Tetrahydrate | 8.4 | 94 | 81 |
| COMPARATIVE FORMULA IV | | | |
| 10. 1% Hydrogen Peroxide | 9.5 | 89 | — |
| 11. 3% Na Perborate Monohydrate | 9.5 | 63 | — |
| 12. 4.5% Na Perborate Tetrahydrate | 9.5 | 53 | — |

The above examples show that aqueous detergent formulations containing suspended, solid oxidant and the inventive stabilizing system have superior long term storage stability over like, but unstabilized, compositions. Additionally, if such stabilizing systems are added to formulations which substitute hydrogen peroxide in equivalent amounts for the suspended oxidants, such formulations have much poorer stability. Accordingly, the foregoing data demonstrate the surprising and unforeseen advantages of the aqueous detergents containing suspended solid oxidant and stabilizing system of alkali metal borate, boric acid, alkali metal chloride, or mixtures thereof.

The invention is further illustrated and embodied by the claims which follow below. However, such claims do not restrict or limit the invention and obvious improvements and equivalents and alternatives, which do not depart from the spirit and scope of the invention are captured thereby.

We claim:

1. A liquid detergent composition containing at least one oxidant, comprising:

a) a liquid phase which comprises:

(i) from about 0.1–90% weight of the composition of at least one surfactant selected from the group consisting of anionic, nonionic, cationic, amphoteric, zwitterionic surfactants, and mixtures thereof wherein any anionic surfactant is present in amounts up to 50% by weight of the composition;

(ii) from about 5–95% by weight of the composition of liquid carrier therefor, comprising water or a mixture of water and at least one organic solvent, said solvent being present in an amount of no more than 0–10% of the liquid carrier;

b) from about 0.1–50% by weight of the composition of a particular oxidant suspended in said liquid phase, which maintains oxidative stability, said oxidant being selected from the group consisting of alkali metal perborates and percarbonates; and c) from about 1–50% by weight of the composition of an oxidant stabilizer, said oxidant stabilizer selected from the group consisting of at least one alkali metal chloride or a mixture of said alkali metal chloride and alkali metal borate or boric acid, or a mixture of the three, said oxidant stabilizer acting to desolubilize said particulate oxidant by maintaining high ionic strength in the liquid phase to maintain oxidant potency.

2. The liquid detergent of claim 1 wherein the oxidant is sodium perborate tetrahydrate.

3. The liquid detergent of claim 1 wherein the oxidant is sodium perborate monohydrate.

4. The liquid detergent of claim 1 wherein the oxidant stabilizer is an alkali metal chloride.

5. The liquid detergent of claim 4 wherein the oxidant stabilizer is sodium chloride,

6. The liquid detergent of claim 1 wherein the oxidant stabilizer is a mixture of alkali metal borate and alkali metal chloride.

7. The liquid detergent of claim 1 further comprising d) at least one adjunct selected from the group consisting of: enzyme, dyes, pigments, fluorescent whitening agents, anti-redeposition agents, foam boosters, anti-foaming agents, chelating agents, bleach activators, anti-oxidants, thickeners, fragrances, and mixtures thereof.

8. The liquid detergent of claim 1, wherein the proportions of the components are a) 0.1–90% of i), 1–99% of ii); b) 0.1–50%; c) 1–50%.

9. A phase stable liquid detergent composition containing an oxidant which is maintained essentially insoluble therein during storage, but which releases active oxygen during use in aqueous wash media, said detergent composition comprising:

a) a liquid phase which comprises:

(i) from 0.1–90% by weight of the composition of a surfactant selected from the group consisting of mixtures of anionic surfactants, nonionic surfactant, and mixtures of nonionic and anionic surfactant wherein any anionic surfactant is present in amounts up to 50% by weight of the composition; and (ii) a liquid carrier therefor which comprises water, or a mixture of water and a water soluble or dispersible organic solvent, said solvent being present in an amount of no more than 0–10% of the liquid carrier;

b) from 0.1–50% by weight of the composition of a particulate oxidant stably suspended in said liquid phase, which oxidant maintains oxidative stability, said oxidant being an alkali metal perborate and percarbonate; and c) from about 1–50% by weight of the composition of an oxidant stabilizer, said oxidant stabilizer selected from the group consisting of at least one alkali metal chloride or a mixture of said alkali metal chloride and alkali metal borate or boric acid, or a mixture of the three, said oxidant stabilizer acting to desolubilize and suspend said particulate oxidant by maintaining high ionic strength in the liquid phase to maintain oxidant potency.

10. The liquid detergent of claim 9 wherein the component i) is a mixture of anionic surfactants selected from sulfonated and sulfated anionic surfactants.

11. The liquid detergent of claim 10 wherein the anionic surfactant comprises a mixture of an alkyl benzene sulfonate and an alkyl ethoxylated sulfate.

12. The liquid detergent of claim 9 further comprising d) an enzyme.

13. The liquid detergent of claim 9 wherein said oxidant stabilizer is at least one alkali metal chloride.

14. The liquid detergent of claim 13 wherein said oxidant stabilizer is sodium chloride.

15. The liquid detergent of claim 9 wherein said oxidant stabilizer is a mixture of borax, boric acid and at least one alkali metal chloride.

16. The liquid detergent of claim 12 wherein said enzyme is selected from the group consisting of proteases, amylases, lipases, cellulases and mixtures thereof.

17. The liquid detergent of claim 12 further comprising e) a fluorescent whitening agent.

18. The liquid detergent of claim 17 further comprising f) a chelating agent.

19. A phase stable liquid detergent composition containing an oxidant which is maintained essentially insoluble therein during storage, but which releases active oxygen during use in aqueous wash media, said detergent composition comprising:

a) a liquid phase which comprises:

(i) from 0.1–90% by weight of a surfactant selected from the group consisting of mixtures of anionic surfactants, nonionic surfactant, and mixtures of nonionic and anionic surfactant wherein any anionic surfactant is present in amounts up to 50% by weight of the composition; and (ii) a liquid carrier therefor which comprises water, or a mixture of water and a water soluble or dispersible organic solvent, said solvent being present in an amount of no more than 0–10% of the liquid carrier; said structured liquid having a yield value of between about 1–15 Pascals; and b) from 0.1–50% by weight of the composition of a particulate oxidant stably suspended in said liquid phase, which oxidant maintains oxidative stability, said oxidant being an alkali metal perborate and percarbonate; and c) from about 1–50% by weight of the composition of an oxidant stabilizer, said oxidant stabilizer selected from the group consisting of at least one alkali metal chloride or a mixture of said alkali metal chloride and alkali metal borate or boric acid, or a mixture of the three.

20. The liquid detergent of claim 1 wherein said oxidant stabilizer is a mixture of boric acid and at least one alkali metal chloride.

21. The liquid detergent of claim 1 wherein said oxidant stabilizer is a mixture of an alkali metal borate, boric acid and at least one alkali metal chloride.

22. The liquid detergent of claim 9 wherein said oxidant stabilizer is a mixture of an alkali metal borate and at least one alkali metal chloride.

23. The liquid detergent of claim 9 wherein said oxidant stabilizer is a mixture of boric acid and at least one metal chloride.

24. The liquid detergent of claim 9 wherein said oxidant stabilizer is a mixture of an alkali metal borate, boric acid and at least one alkali metal chloride.

* * * * *